United States Patent [19]

Warwick

[11] Patent Number: 4,799,812

[45] Date of Patent: Jan. 24, 1989

[54] COMPUTER PAGE PLACE MARKER

[76] Inventor: Amparo A. Warwick, 47 Beechwood Dr., Waldorf, Md. 20601

[21] Appl. No.: 155,543

[22] Filed: Feb. 12, 1988

Related U.S. Application Data

[63] Continuation of Ser. No. 829,197, Feb. 14, 1986, abandoned.

[51] Int. Cl.[4] ..... B41J 11/26; B41J 11/64

[52] U.S. Cl. ..... 400/616; 400/616.1; 400/705.4; 400/705.5; 400/706; 116/240

[58] Field of Search ..... 400/616, 616.1, 616.2, 400/616.3, 705.4, 705.5, 706, 706.1, 718, 718.1, 718.2; 248/441.1, 442.2, 444.1; 211/50, 51, 54.1, 57.1; 33/430, 443, 448, 483, 484, 485, 486, 487, 488, 489, 490, 491, 492, 493, 494; 116/234, 235, 236, 237, 240; 226/6, 52

[56] References Cited

U.S. PATENT DOCUMENTS

| | | | |
|---|---|---|---|
| 700,156 | 5/1902 | Simpson | 33/489 |
| 1,383,140 | 6/1921 | Naterman | 33/485 X |
| 1,627,110 | 5/1927 | Norris | 400/706 |
| 1,694,519 | 12/1928 | Smith | 400/706 X |
| 2,093,783 | 9/1937 | Shulkin | 33/443 |
| 2,562,479 | 7/1951 | Spikes | 33/443 |
| 2,633,644 | 4/1953 | May | 33/443 X |
| 3,087,497 | 4/1963 | Vakkinen | 33/430 X |
| 3,089,245 | 5/1963 | Cromer et al. | 33/430 X |
| 3,292,763 | 12/1966 | Whitehead | 400/616 X |
| 3,587,812 | 6/1971 | Budenstein et al. | 400/616.1 X |
| 4,503,615 | 3/1985 | Schreiber | 400/705.5 X |
| 4,564,414 | 1/1986 | Houssian et al. | 33/430 X |
| 4,611,719 | 9/1986 | Dudek et al. | 211/50 |
| 4,688,510 | 8/1987 | McNeely | 33/485 X |

FOREIGN PATENT DOCUMENTS

| | | | |
|---|---|---|---|
| 95193 | 3/1939 | Sweden | 33/443 |
| 97022 | 10/1939 | Sweden | 33/443 |
| 0848382 | 7/1981 | U.S.S.R. | 33/430 |

OTHER PUBLICATIONS

IBM Technical Disclosure Bulletin, "Continuous Fanfold Paper Feed", Crawford, vol. 13 No. 2 Jul. 1970, p. 336.

*Primary Examiner*—Ernest T. Wright, Jr.
*Attorney, Agent, or Firm*—Nicholas J. Aquilino

[57] ABSTRACT

A flexible elongated transparent computer page place marker having a longitudinal marking surface for locating specific printed lines of information on a standard printed computer page and raised projections extending from the underside thereof for engagement of the tractor drive holes on the computer page. The marker includes a longitudinal slit having a plurality of column locators positioned within the slit and slidably moveable therein for locating column information on said computer page. In one embodiment, the marker includes a tab at one end thereof adapted to be placed under a computer printed page when the marker is supported on top of the page to secure the marker to the paper and aid in positioning thereon.

7 Claims, 2 Drawing Sheets

COMPUTER PAGE PLACE MARKER

RELATED APPLICATIONS

The present invention is a continuation application of Ser. No. 06/829,197, filed Feb. 14, 1986 entitled "Computer Page Place Marker", now abandoned.

BACKGROUND OF THE INVENTION

The present invention relates to a place marker, and more particularly, to a place marker adapted for use with standard computer printout sheets of paper.

The use of computers and various data storage equipment has become commonplace in the present business community. Reams of information are being made available by computer which hereinbefore had to be done manually. This large volume of information is generally printed out using computer printers adapted to operate with information supplied from the computer. The printing is done on conventional computer print paper which is fed through the printer using a tractor drive which engages a plurality of holes on both sides of the computer paper and uses the holes to drive the paper through the printer.

Most computer paper is at least 14 and ⅞ inches wide and can contain a plurality of columns of information. When working with this information, it is often difficult to find a particular location on the paper for specific information and even more difficult to keep that particular location marked without the use of some type of marker instrument or marking device.

The present invention relates to a computer page place marker which is specifically adapted for use with computer paper having holes in the margins for driving the paper through the printer. The place marker is formed of a transparent, rectangular flexible plastic member having at least one edge or surface in the longitudinal direction for marking printed lines on the computer page. The marker includes raised projections on the underside thereof which are specifically spaced and adapted to fit into the holes in the computer paper margins. The place marker further includes a series of column locators which can be moved along the longitudinal access of the place marker so that specific columns along any given printed line may be identified and located. In one embodiment, the place marker includes a flexible flap cut out of the marker structure which is then placed under the computer paper in order to aid in the retention of the marker on the paper and to facilitate the movement of the place marker along the edge of the paper.

Among the objects of the present invention is the provision of a computer page place marker which is simple in construction and easy to use, which provides a means for engaging the edges of the computer paper to insure proper retention, and column locator means for locating specific areas of information on the printed computer page.

DESCRIPTION OF THE PREFERRED EMBODIMENTS

Figure 1:
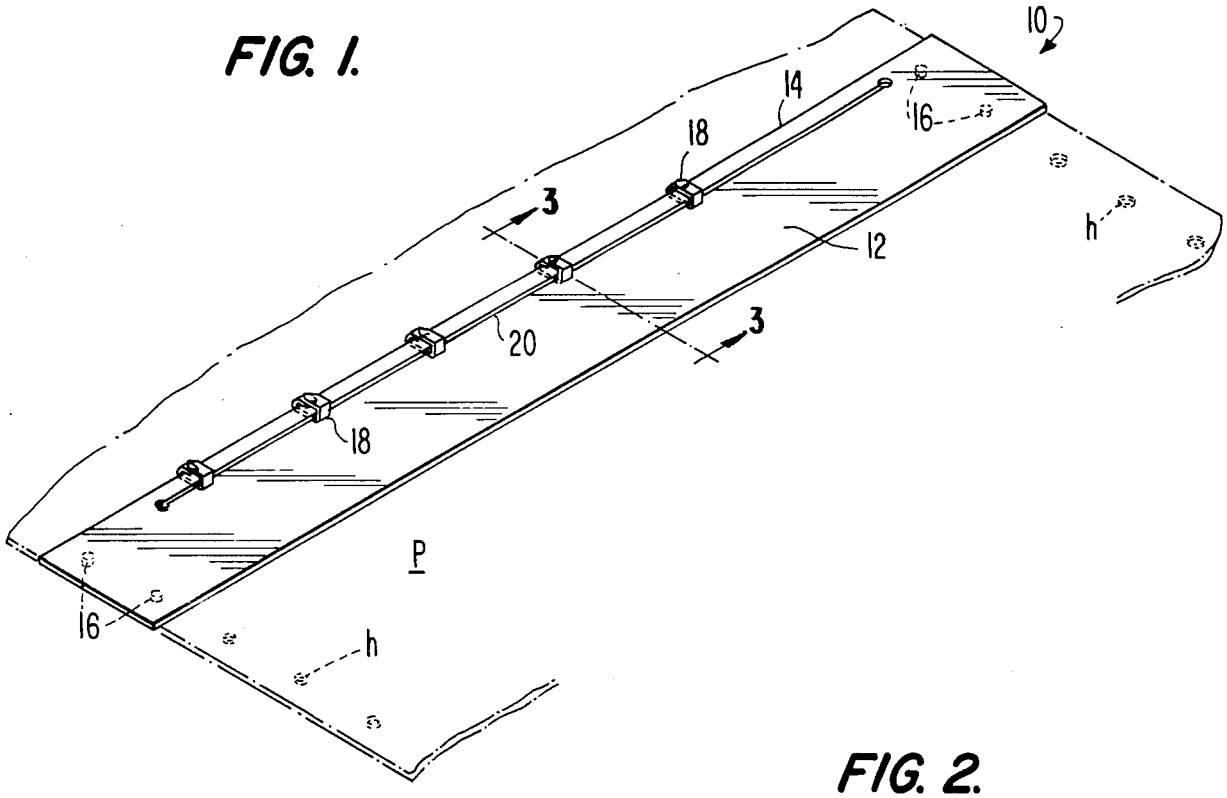
FIG. 1 is a perspective view of the computer paper place marker of the present invention.
Figure 2:
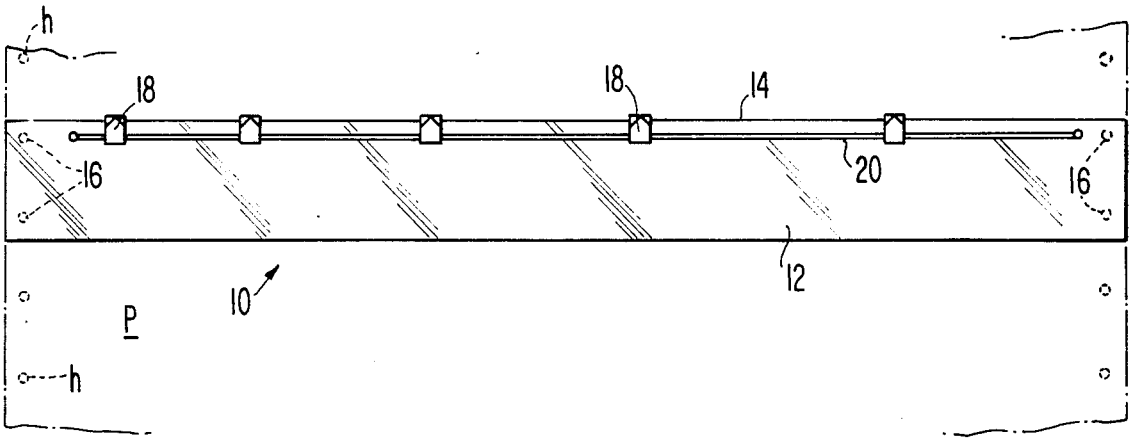
FIG. 2 is a top plan view of FIG. 1.
Figure 3:
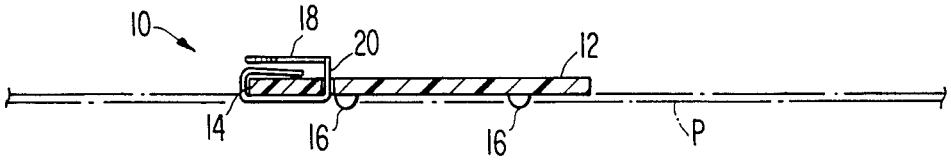
FIG. 3 is a sectional view taken along the line 3—3 of FIG. 1.
Figure 4:
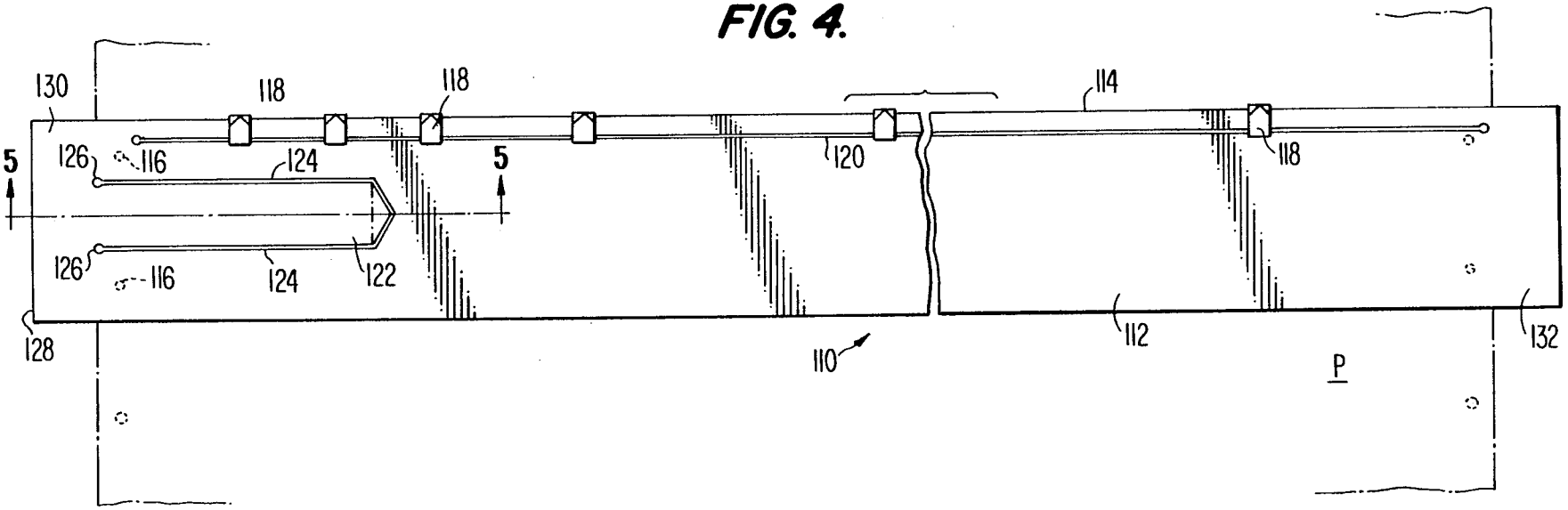
FIG. 4 is a top plan view of a second embodiment of the present invention.

FIGS. 1 to 3 illustrate a first embodiment of the computer paper place marker 10 of the present invention positioned on a length of standard computer paper P having drive holes h located on opposite edges of the computer page and in a line perpendicular to the width of the page P between the opposite edges.

The place marker 10 is formed of a generally elongated rectangular marker member 12 made of acrylic or other flexible transparent plastic. Preferably, the marker 10 is sized in a longitudinal direction to fit the width of the computer paper P to be marked. A suitably sized place marker 10 is 14⅞ inches long, and approximately 1½ inches wide. The upper edge 14 of the place marker 10 is straight and extends the entire longitudinal dimension of the marker member 12 and is used to locate specific lines of printed information on the computer paper P.

The underside of the marker 10 is provided with a pair of raised, rounded projections 16 at each end of the marker 10. The projections 16 are vertically in line with each other at each end of the place marker 10 in the same direction as the drive holes h on the computer paper P and the projections 16 are perpendicular to the upper edge 14 of the place marker 10. The projections 16 are exactly one inch apart so that they are able to engage two of the holes h on the computer paper edges which also are exactly ½ inch apart in standard computer paper P. The projections 16 would be spaced approximately ¼ inch from the edge of the place marker 10 in order to properly align with the holes h in the computer paper P.

Preferably, the place marker 10 would include a plurality of column locators 18 which are slidably positioned within a longitudinal slit 20 parallel to the upper edge 14 of the marker 10, as best seen in the sectional view of FIG. 3. The locators 18 may be colored or include various types of indicia in order to mark particular columns of information printed on the computer paper P. The locators 18 may be of various shapes and need only be slidable within the slit 20 with nominal finger pressure in order that they be positioned adjacent various columns of information.

In use, the place marker 10 is located on the computer paper P using the projections 16 which engage the drive holes h on the paper edge. The place marker 10 may be slid easily up and down the papers P by simply lifting the projections 16 out of the holes h on the paper edge and replacing the projections 16 into other holes h at another location. The top edge 14 of the place marker 10 locates or marks a particular line of information on the paper P that is being worked with, thereby enabling a user to leave the line location and return to it at a later time to begin reworking that place without re-searching for the particular location. Similarly, the use of the column locators 18 enables a user to mark the exact location of a particular column for subsequent use. The transparent quality of the marker 10 permits working with the whole page of paper P without blocking a portion of the information.

FIGS. 4 to 7 illustrate a second embodiment of the computer paper place marker 110 of the present invention. In this embodiment, the marker 110 is also formed of a rectangular, flexible, transparent plastic member 112 having an upper locating edge 114 and includes raised, rounded projections 116 on the underside of each end of the marker 110. The marker 110 includes a series of column locators 118 which are moveable in a longitudinal slit 120. These features are the same as described with respect to the embodiment of the place marker 10 shown in FIGS. 1 to 3. The present embodiment of the place marker 110 includes a resilient paper engaging tab 122 approximately two inches long and $\frac{7}{8}$ of an inch wide cut from the plastic marker 110 by slits 124. The ends of the slits 124 which also define the end of the tab 122, are provided with small, 1/16 of an inch, diameter holes 126 for stability and to eliminate stress at these points when the tab 122 is raised and/or lowered. The tab 122 is positioned approximately $\frac{5}{8}$ of an inch from the edge 128 of the place marker 110.

Figure 7:
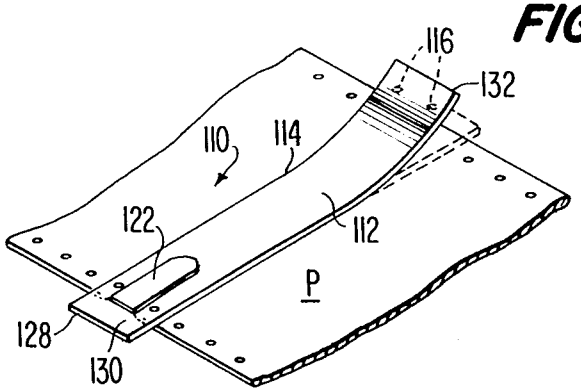
FIG. 7 is a perspective view of the embodiment of FIG. 4.
Figure 5:
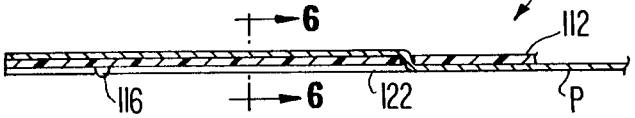
FIG. 5 is a partial sectional view taken along the line 5—5 of FIG. 4.
Figure 6:
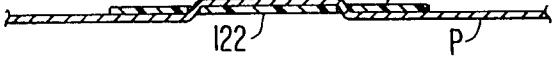
FIG. 6 is a partial sectional view taken along the line 6—6 of FIG. 5.

In use, the projections 116 locate the place marker 110 on the computer paper P and the column locators 118 mark the column as described hereinabove. In this embodiment, the tab 122 is placed under the edge of the paper P and thereby grips the paper P as best seen by referring to FIGS. 5 and 6. The end section 130 of the place marker 110 extends beyond the edge of the paper P and this section 130 serves to easily mark the location of the place marker 110 particularly when the paper P is folded or stacked upon itself. The place marker 110 is flexible enough to permit the end 132 opposite the tab 122 to be picked up with the fingers and used to slide the entire marker 110 to another set of holes while the tab 122 retains a grip on the paper P as shown in FIG. 7.

I claim:

1. A place marker for a printed computer page having vertically positioned drive holes located adjacent opposite margins of the page, said place marker being characterized by:

a flexible, elongated marker member having at least one straight longitudinal marking edge, said flexible elongated marker member including at least two raised projections extending from the underside of said member;

said two raised projections being located adjacent one end of said elongated marker member and positioned in-line and in a direction perpendicular to said straight longitudinal marking edge at the said one end of said member and spaced at a distance corresponding to a distance between ones of said vertically positioned drive holes on one of said opposite sides of said printed computer page;

whereby, in use, said raised projections are placed in said drive holes of said printed computer page at specific locations on said page and said straight longitudinal marking edge is used to locate specific lines on said page.

2. A place marker for a printed computer page having a plurality of vertically positioned drive holes located adjacent opposite margins of the page, said place marker being characterized by:

a flexible elongated marker member; said elongated marker member including at least one longitudinal marking edge along the length of said member;

said elongated marker member having at least two raised projections extending from the underside of said member, said projections being located adjacent one end of said elongated marker member and positioned in-line and in a direction perpendicular to said straight longitudinal marking edge at the said one end of said member and spaced at a distance corresponding to a distance between ones of said vertically positioned drive holes on one of said opposite sides of said printed computer page;

a longitudinal slit in said elongated member; said slit being located parallel to said longitudinal marking edge; a plurality of column locators slidably positioned within said slit;

whereby, in use, said elongated marker member is placed on said printed computer page, said projections engaging said drive holes for locating said elongated marker member at specific locations on said page, said longitudinal marking edge locating specific lines across said computer page and said column locators being slidably moveable within said slit to locate particular columns of information on said computer page.

3. The place marker of claim 2, further including a tab formed in said elongated marker member at one end thereof, in use, said tab being placed under said computer page when said place marker is supported on top of said computer page.

4. The place marker of claim 2 wherein said elongated marker member is made of transparent plastic.

5. The place marker of claim 2 wherein said raised projections are located at specific, fixed distances from each other, said distances corresponding to the distances between said tractor drive holes on said computer page.

6. The place marker of claim 2 wherein said column locators are positioned adjacent said longitudinal marking edge.

7. The place marker of claim 1 further including a second pair of two raised projections extending from the underside of said elongated marker member, located at a second end of said marker opposite said one end for engaging drive holes on the opposite side of said printed computer page.

* * * * *